United States Patent [19]

LeBlanc

[11] Patent Number: 4,981,583

[45] **Date of Patent: * Jan. 1, 1991**

[54] HIGH CONSISTENCY PRESSURE SCREEN AND METHOD OF SEPARATING ACCEPTS AND REJECTS

[75] Inventor: Peter E. LeBlanc, Worthington, Mass.

[73] Assignee: Beloit Corporation, Beloit, Wis.

[ * ] Notice: The portion of the term of this patent subsequent to Aug. 8, 2006 has been disclaimed.

[21] Appl. No.: 363,668

[22] Filed: Jun. 8, 1989

Related U.S. Application Data

[62] Division of Ser. No. 746,734, Jun. 20, 1985, Pat. No. 4,855,038.

[51] Int. Cl.[5] ..... B01D 29/38

[52] U.S. Cl. ..... 209/273; 209/300

[58] Field of Search ..... 209/273, 270, 268, 306, 209/305, 240, 250, 300, 379; 210/413–415; 162/55

[56] References Cited

U.S. PATENT DOCUMENTS

| | | | |
|---|---|---|---|
| 1,974,651 | 9/1934 | Haug | 209/300 |
| 3,363,759 | 1/1968 | Clarke-Pounder | 209/306 |
| 3,400,820 | 9/1968 | Nelson | 209/306 |
| 3,437,204 | 4/1969 | Clarke-Pounder | 209/273 |
| 3,581,893 | 6/1971 | Rich | 209/283 |
| 3,680,696 | 8/1972 | Morin | 209/240 |
| 3,726,401 | 4/1973 | Bolton, III | 209/306 |
| 3,814,244 | 6/1974 | Young | 209/273 |
| 4,200,537 | 4/1980 | Lamort | 209/379 |
| 4,462,901 | 6/1984 | Gauld | 209/273 |
| 4,676,903 | 6/1987 | Lampenius | 209/273 X |
| 4,855,038 | 8/1989 | LeBlanc | 209/273 |

FOREIGN PATENT DOCUMENTS

| | | |
|---|---|---|
| 129814 | 2/1978 | Fed. Rep. of Germany . |
| 2410811 | 6/1979 | France . |
| 0032594 | 8/1984 | Japan . |

*Primary Examiner*—Donald T. Hajec

*Attorney, Agent, or Firm*—Dirk J. Veneman; Raymond W. Campbell

[57] ABSTRACT

A high consistency pressure screen comprises a screen including a profiled inner surface and a rotor including a profiled outer surface rotating adjacent and spaced from the profiled screen to produce a positive-negative pulsation cycle of approximately 50%—50%.

3 Claims, 2 Drawing Sheets

HIGH CONSISTENCY PRESSURE SCREEN AND METHOD OF SEPARATING ACCEPTS AND REJECTS

This is a divisional of copending application Ser. No. 06/746,734 filed on June 20, 1985 now U.S. Pat. No. 4,855,038.

BACKGROUND OF THE INVENTION

1. Field of the Invention

The present invention relates to a method for separating accepts and rejects from a slurry of paper stock and to a high consistency pressure screen for carrying out the method.

2. Description of the Prior Art

In his U.S. Pat. No. 3,363,759 I. J. Clarke-Pounder discloses a screening device which utilizes a screen or basket having a smooth interior surface spaced from a rotor which has dense and/or projections on its outer surface for producing localized changes in volume in the screening zone. In his U.S. Pat. No. 3,437,204 Clarke-Pounder discloses a similar device in which the rejects are reduced by introducing dilution liquid into the material as it flows through the screening zone and across the screen.

Joseph A. Bolton III and Peter E. LeBlanc, in their U.S. Pat. No. 3,726,401 also disclose the use of a rotor having spaced projections in the form of bumps for creating a pulsation during screening, namely alternate positive screening pulses and negative screen-cleaning pulses.

Ahlstrom Machinery Inc. of Glens Falls, New York, produces "profile" screens for use in pressure screen devices.

SUMMARY OF THE INVENTION

The primary object of the present invention is to provide a method and apparatus for high consistency pressure screening having low reject rates and low power consumption with a minimum fiber classification.

The above object is achieved, according to the present invention, by flowing a slurry of paper stock through a screening zone between a rotor and a screen and creating in the screening zone continuous cyclic positive and negative pulses each of which covers approximately 50% of a pulsation cycle. Typically, in a conventional screen the pulsation cycle includes a very brief positive pulse, a somewhat longer negative pulse and, during 50% of the cycle, no pulse magnitude. Flowing slurry, now subjected to the 50—50 pulsation cycle is subjected to continuous volumetric changes in the screening zone. Screening is advantageously achieved by providing a profile screen and by further providing a rotor having a profiled surface. The profile surface of the rotor comprises a blunt leading surface facing in the direction of rotation of the rotor, followed by an arcuate surface which recedes from the screen and therefore increases the volume between the rotor and the screen. Advantageously, and as viewed from the end of the rotor, the rotor appears as a double or quadruple cam structure. In addition to creating continuous positive and negative pulses the cams create great turbulence of the stock along the screen.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
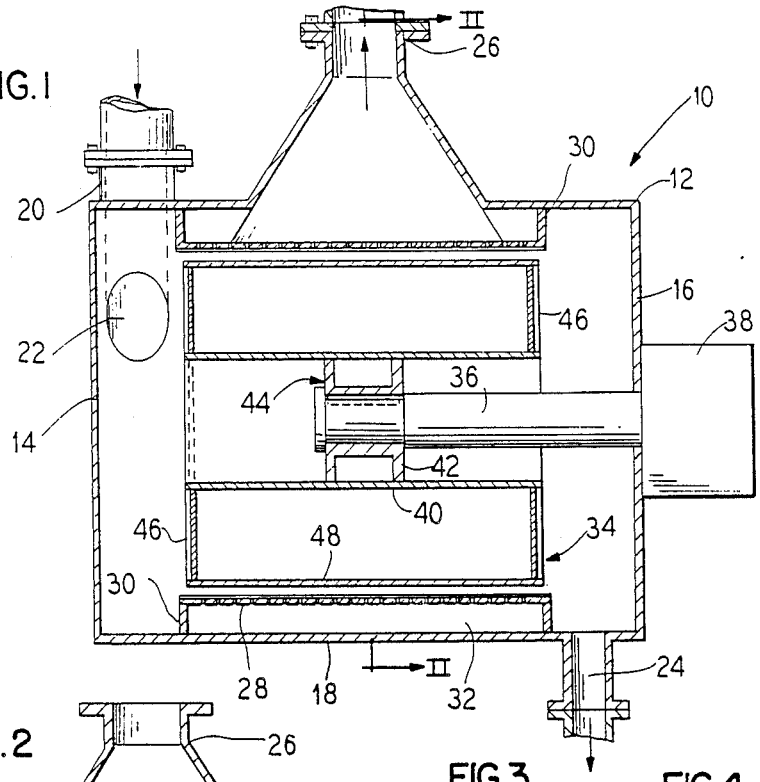
FIG. 1 is a longitudinal sectional view of a pressure screen constructed in accordance with the present invention.

Referring to FIGS. 1–4, screening apparatus is generally illustrated at 10 as comprising a housing 12, a pair of end walls 14, 16 and an outer, generally cylindrical wall 18. A slurry of paper stock is pumped, under pressure, through an inlet conduit 20 and enters the housing through an opening 22 at one end and flows toward a rejects outlet 24 and an accepts outlet 26.

Mounted within the housing and in the path of the aforementioned flow is a profile screen 28 mounted to the inner surface of the housing by a pair of rings 30 which, with the housing wall 18 and the screen 28, form an accepts chamber 32.

A rotor 34 is mounted on a drive shaft 36 driven by a drive 38. The rotor 34 comprises a hollow cylinder 40 which is connected to a member 42 keyed to the shaft 36, as indicated at 44. The rotor 34 further comprises end plates 46 connecting an outer wall 48 to the hollow cylinder 40 and sealing the ends of the rotor with respect to the flow of slurry.

Figure 2:
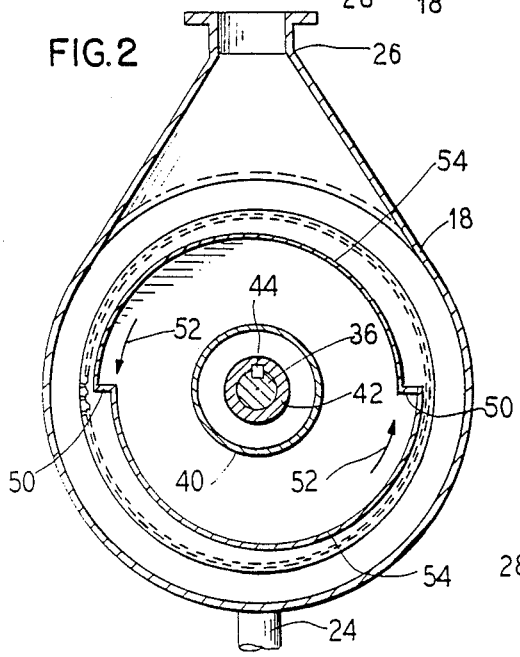
FIG. 2 is a sectional view taken substantially along the line II-II of FIG. 1.

As best seen in FIG. 2, the rotor 34 comprises a cam-like configuration including a pair of blunt leading edges 50 extending substantially the length of the cylinder 40 and facing in the direction of rotation 52, respectively followed by arcuate sections 54. In a particular construction, the arcuate sections 54 have the same radius of curvature with the respective centers of the radii diametrically offset with respect to the axis of rotation. Although only two of such semicylindrical structures have been shown, a plurality may be provided for very large pressure screens. As used in the specification and claims hereof, "blunt" when used in reference to the rotor shall mean a surface so shaped as to be capable of capturing a certain volume of stock and accelerating it up to rotor velocity. Thus, for example, the leading edges 50 could be forwardly inclined with respect to the direction of rotation, or could be concave in shape.

Figure 3:
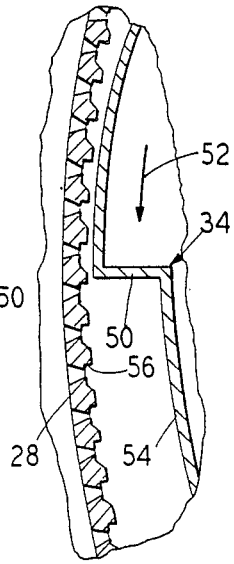
FIG. 3 is a fragmentary sectional view particularly illustrating the relationship between the inner surface of the profile screen and the profile surface of the rotor, utilizing a first type of profile screen.
Figure 4:
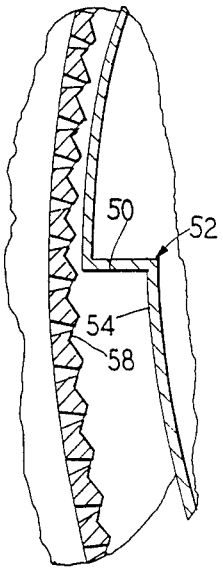
FIG. 4 is a fragmentary sectional view, similar to that of FIG. 3, showing the use of a second type of profile screen.
Figure 5:
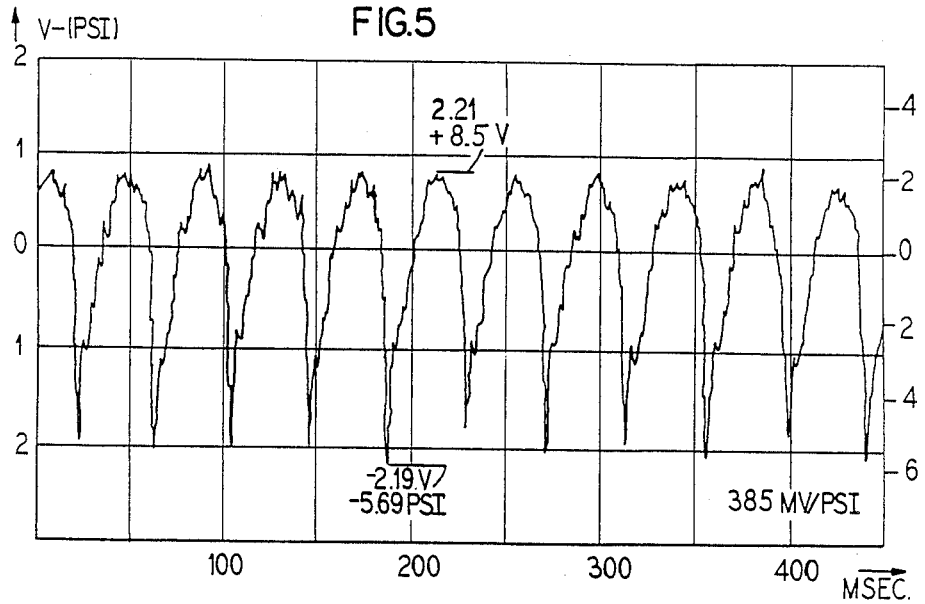
FIG. 5 is a graphic representation of the pulsations measured in the pressure screen.

Referring to FIGS. 3 and 4, two different profiled surfaces are illustrated for the screen, namely the profile 56 in FIG. 3 and the profile 58 in FIG. 4. Normally, the profile is only provided on the inner surface of the screen, and other profiles than those shown could also be used.

After realizing the pulsation phenomenon set forth above, investigations were undertaken to determine the cause thereof, including the geometric causes, the dynamic causes and the stock causes. In the area of geometric causes the sharp positive pressure pulse, the area of negative and positive pressure pulses, the condition of the screen plate surface and the rotor-screen clearance were investigated. As dynamic causes, the surface speed of the rotor, the pulse frequency and the pressure drops over the screen were considered. The stock causes include consistency, temperature and type of fiber.

Investigations were undertaken using milk carton stock at 4.5% consistency. A pump capacity of about 1200 GPM was attained utilizing a 0.078" perforate screen and a 0.055" perforate screen with more than 300 T/D processed using 25 HP. It was determined that at 5.5% rejects by weight, a debris removal of 52% was attained using the 0.078" screen and a debris removal of 71% with the 0.055" screen. The inlet to accept freeness dropped an average of 8 points for the 0.078" screen and increased by 10 points on the 0.55" screen. The screens were stable on all tests and can easily screen milk carton stock.

In carrying out the aforementioned test, milk carton stock was pulped in a 1000# Tridyne which 1.5% sodium hypoclorite for approximately 30 minutes. The stock was extracted through ⅛" perforations in a pulper grate at 5.01% consistency. No debris was added to the stock; however, there were many small flakes and plastics in the pulp. In essence, this pulp was prescreened by the ⅛" perforations in the pulper.

With the rotor shown in FIG. 2, the 0.078" screen and the 0.055" screen were used and the rotor was run at a constant 750 RPM. The screen system was initially filled with water which diluted the pulp from 5% to 4.5%. A series of flows were selected so that a pressure drop verses flow curve could be generated. Reject flow was held to approximately 10% of the accepts for these tests. Samples of the inlet, accept and reject stock were taken at nominal mill production rates in one test and at pump capacity in a second test. In a third test, pump capacity was also utilized, but at a 5% rejects flow.

The following schedules of table 1 and 2 show the data gathered during the aforementioned trials.

TABLE 1

Basket: .078 Perf.
Material: Milk Carton
Consistency: 4.4%
Reject Rate: 10%

| Trial No. | Rotor Speed RPM | Motor Speed BHP | Pressure PSI In | Pressure PSI Acc | ΔP | Flow GPM Acc | Flow GPM Rej | Flow GPM Inlet | Consistency % In | Consistency % Acc | Consistency % Rej |
|---|---|---|---|---|---|---|---|---|---|---|---|
| 1 | 750 | 28.6 | 6.5 | 4.8 | 1.7 | 330 | 55 | 385 | — | — | — |
| | 750 | 28.3 | 8.5 | 6.5 | 2 | 423 | 49 | 472 | 4.51 | 4.35 | 4.70 |
| | 750 | 28.0 | 11.2 | 8.7 | 2.5 | 540 | 55 | 595 | — | — | — |
| | 750 | 27.8 | 13.9 | 11.1 | 2.8 | 625 | 64 | 689 | — | — | — |
| | 750 | 27.3 | 17.2 | 13.7 | 3.5 | 710 | 73 | 783 | — | — | — |
| | 750 | 26.6 | 17.3 | 13.1 | 4.2 | 853 | 75 | 925 | — | — | — |
| | 750 | 26.2 | 19.6 | 14.8 | 4.8 | 920 | 90 | 1010 | — | — | — |
| | 750 | 25.7 | 22.1 | 16.7 | 5.4 | 1010 | 97 | 1107 | — | — | — |
| 2 | 750 | 225.0 | 26.9 | 20.3 | 6.6 | 1165 | 109 | 1274 | 4.47 | 4.34 | 5.34 |
| 3 | 750 | 25.0 | 27.9 | 21.1 | 6.8 | 1148 | 54 | 1202 | 4.45 | 4.11 | 5.72 |

| Trial No. | Throughput T/D In | Throughput T/D Acc | Throughput T/D Rej | CSF Freeness In | CSF Freeness Acc | CSF Freeness Rej | % Debris In | % Debris Acc | % Debris Rej | % Rejects by Weight |
|---|---|---|---|---|---|---|---|---|---|---|
| 1 | 104.2 | — | — | — | — | — | — | — | — | — |
| | 127.7 | 110.4 | 13.8 | 395 | 410 | 470 | 1.32 | .47 | 7.85 | 10.9 |
| | 161.0 | — | — | — | — | — | — | — | — | — |
| | 186.4 | — | — | — | — | — | — | — | — | — |
| | 211.9 | — | — | — | — | — | — | — | — | — |
| | 250.3 | — | — | — | — | — | — | — | — | — |
| | 273.3 | — | — | — | — | — | — | — | — | — |
| | 299.5 | — | — | — | — | — | — | — | — | — |
| 2 | 344.7 | 303.4 | 34.9 | 420 | 390 | 500 | .68 | .22 | 2.33 | 10.2 |
| 3 | 325.3 | 283.0 | 18.5 | 395 | 385 | 520 | .52 | .25 | 1.79 | 5.9 |

| Debris Removal | Reject Rate |
|---|---|
| Trial 1 = 64.4% | 10.9% |
| Trial 2 = 67.6% | 10.2% |
| Trial 3 = 51.9% | 5.9% |

Table 1 lists the data for the 0.078" perforate screen. It should be noted that as flow increases the motor load decreases. This is caused primarily by a higher inlet stock velocity which decreases the relative rotor to stock velocities and requires less power. At the high flows, the power required was about 0.08 HPD/Acc. Ton. A small change is noted in the consistencies at the 10% rejects rate and a larger change at the 5% rejects rate. The freeness change did not appear to be affected by the reject rate and is small although there is a change from the inlet to the accepts.

TABLE 2

Basket: .055 Perf.
Material: Milk Carton
Consistency: 4.4%

| Trial | Rotor Speed | Motor Load | Pressure PSI | Flow GPM | Consistency % |
|---|---|---|---|---|---|

TABLE 2-continued

| No. | RPM | BHP | In | Acc | ΔP | Acc | Rej | Inlet | In | Acc | Rej |
|---|---|---|---|---|---|---|---|---|---|---|---|
| 4 | 750 | 29.2 | 5.0 | 3.4 | 1.6 | 360 | 53 | 413 | — | — | — |
| | 750 | 28.7 | 6.9 | 4.6 | 2.3 | 480 | 53 | 533 | — | — | — |
| | 750 | 28.0 | 8.8 | 6.3 | 2.5 | 550 | 55 | 605 | 4.25 | 4.25 | 2.48 |
| | 750 | 27.6 | 10.6 | 7.7 | 2.9 | 632 | 60 | 692 | — | — | — |
| | 750 | 26.6 | 14.2 | 10.5 | 3.7 | 750 | 76 | 826 | — | — | — |
| | 750 | 25.8 | 17.0 | 12.5 | 4.5 | 845 | 82 | 927 | — | — | — |
| | 750 | 25.0 | 19.6 | 14.4 | 5.2 | 918 | 86 | 1004 | — | — | — |
| | 750 | 24.2 | 22.6 | 16.7 | 5.9 | 1006 | 96 | 1102 | — | — | — |
| | 750 | 23.6 | 25.1 | 18.2 | 6.9 | 1063 | 98 | 1161 | — | — | — |
| | 750 | 23.0 | 26.0 | 18.0 | 8.0 | 1090 | 90 | 1180 | — | — | — |

| Trial | Throughput T/D | | | CSF Freeness | | | % Debris | | | % Rejects |
|---|---|---|---|---|---|---|---|---|---|---|
| No. | In | Acc | Rej | In | Acc | Rej | In | Acc | Rej | by Weight |
| 4 | 105.3 | — | — | — | — | — | — | — | — | — |
| | 135.9 | — | — | — | — | — | — | — | — | — |
| | 154.3 | 140.3 | 8.2 | 405 | 415 | 295 | .62 | .18 | 1.69 | 5.4 |
| | 176.5 | — | — | — | — | — | — | — | — | — |
| | 210.6 | — | — | — | — | — | — | — | — | — |
| | 236.4 | — | — | — | — | — | — | — | — | — |
| | 256.0 | — | — | — | — | — | — | — | — | — |
| | 281.0 | — | — | — | — | — | — | — | — | — |
| | 296.0 | — | — | — | — | — | — | — | — | — |
| | 300.9 | — | — | — | — | — | — | — | — | — |

Debris Removal
Trial 4 = 70.96% @ 5.4% Reject Rate

Table 2 lists the data for the 0.055" perforate screen. The power is essentially the same as above at less than 0.1 HPD/T at high flows. The freeness change with this screen illustrates the accept CFS higher than the feed with the reject CFS lower than the feed. This is normal for smaller perforations, but the effects are magnified by the large plastics in the reject stream, which are sufficiently large to drop the freeness and sufficiently light to change the consistency.

Figure 6:
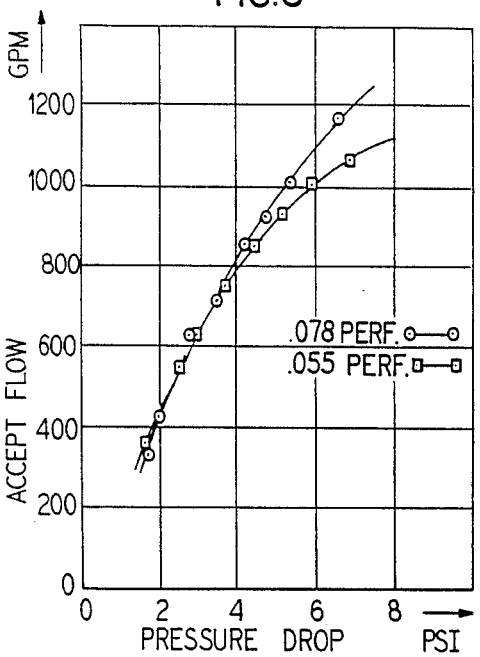
FIG. 6 is a graphic illustration of the pressure drop verses the accept flow for a pressure screen constructed in accordance with the present invention.

Referring to FIG. 6, the pressure drop verses the accept flow is illustrated for both screens. The upper limit on both screens was the pump capacity and not the screen. The 0.055" curve is almost at the maximum while the 0.078" curve shows that additional capacity is available.

Figure 7:
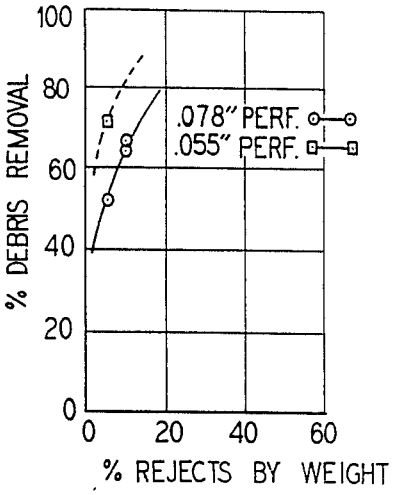
FIG. 7 is a graphic illustration of the debris removal verses the percent of rejects by weight for a pressure screen constructed in accordance with the present invention.

Referring to FIG. 7, the debris removal for both screens is illustrated with respect to the percent rejects by weight. As shown, the 0.055" screen provided better debris removal thab the 0.078" screen. At a reject rate of 5.5% rejects by weight, the debris removal was 52% for the 0.078" screen and was 71% for the 0.055" screen.

The debris content was measured using an image analyzer. Four one gram view sheets were made from each pulp sample. The analyzer was set to count as large a section as possible of the sheet, which amounted to about 80% of the sheet. Sensitivity was set such that the particles which were visible to the eye were counted. The magnification amounted to about 1.4X to achieve the visual to analyzer correlation. The results of these tests are tabulated below in Table 3 showing the debris area measured for each inlet, accept and reject sample. The debris removal is calculated from the equation $$\% \text{ Debris Removal} = 1 - \frac{\text{Accepts Debris}}{\text{Rejects Debris}} \times 100.$$

TABLE 3

| | Test 1 | Test 2 | Test 3 | Test 4 |
|---|---|---|---|---|
| IN | 0.01318 | 0.00681 | 0.00512 | 0.00620 |
| ACC | 0.00473 | 0.00222 | 0.00251 | 0.00182 |
| REJ | 0.02845 | 0.02324 | 0.01786 | 0.00620 |

TABLE 3-continued

| | Test 1 | Test 2 | Test 3 | Test 4 |
|---|---|---|---|---|
| % DR | 64.1 | 67 | 51 | 70.6 |

From these tests and observations, a theory has been developed on why the rotor and screen as described herein operate superiorly to other screen apparatus known in the art. Previous lobe screens, foil screens and the like have created positive pulses while moving through the stock without significantly introducing turbulent energy into the stock. There is minimal stock fluidization generated in these designs. The blunt leading edges 50 in the present invention move through the stock, each capturing a certain volume of stock and accelerating it in the tangential direction of the rotor up to rotor speed. At this high velocity, stock moves past the profile screen 28, as significant turbulence is generated along the cylinder surface, highly fluidizing the stock. This high fluidization prevents agglomeration, floccing or matting of the individual fibers in the stock, and enables the screen to function at much higher consistencies than conventional screens. When floccing or agglomeration occurs, the individual fibers cannot pass through the screen cylinder holes, and for this reason screening previously has been done at much lower consistencies.

As mentioned previously herein, during one cycle approximately 50% of the cycle is a positive pulse, and 50% a negative pulse with no substantial period of time wherein stock near the screen experiences no pulse. This is substantially different from conventional screens which have periods of positive and negative pulse, but also substantial periods of zero pulse. The long duration negative pulse in the present invention creates a back flow or flushing through the screen plate. Because of the design of the profiled screens, it is much more difficult for the fibers to pass in the reverse direction than in the screening direction of the positive pulse. Additionally, on the outside of the screen basket, there is very little turbulence when compared to the turbulence generated on the inside of the screen cylinder by the blunt leading edge during the positive pulse. Therefore, during the period of negative pulse, the back flow from the accept side to the inlet side of the screen is primarily flow of water only. The stock on the accept side of the screen tends to form a mat on the accept side, and therefore there is merely a dewatering function. This theory has been substantiated by the test findings that the accepts' consistency is generally at least slightly higher than the inlet consistency, and the reject consistency is lower than the inlet consistency. Therefore, the accepts are dewatered to a certain extent, most likely during the negative pulse phase of each cycle. Test have also indicated that the smaller the perforations on the screen, the greater the dewatering phenomenon. This can be explained by the poor mat formation in the large perforation screens which allow accepts fiber to flow back with the water during the negative pulse.

Prior to the present invention, conventional screening was performed at about 2% consistency with some screens, though less efficient, operating at about 4% consistency. The present screen has operated at 4%, 5% and 6% consistency without any decline in the debris removal efficiency and without an increase in the reject rate. In all other known screens as consistency is increased, the debris removal efficiency is decreased and the reject rate increases. In the present screen, increasing consistency has not coincided with decreased efficiency and increased reject rate. This result can be explained in the present screen by the fact that the blunt leading edge of the rotor creates greater turbulence and fluidization of the stock thereby allowing stock to flow through the plate at high consistency. During the negative pulse phase, the back flush or dewatering dilutes the stock within the screen thereby eliminating the normal thickening of the screen zone stock and the rejects which occurs in other screens.

Yet another advantage achieved by the present invention is that the rotor can be operated at greater clearance from the screen than other blade or foil type screens. Junk or debris contained in the stock will not wedge between the rotor and screen, which can be a problem in other types of screens.

Although I have described my invention by reference to particular illustrative embodiments thereof and with reference to specific test results, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In a pressure screen of the type in which a slurry of paper stock is fed through an inlet and towards an accepts outlet, through a profile screen and towards a rejects outlet between the screen and a rotor, the improvement wherein said rotor comprises:

an elongate generally cylindrical body including a pair of elongate semicylinders radially offset from one another; and a pair of members connecting said semicylinders and defining a pair of blunt lead edges with respect to the direction of rotation, said blunt lead edges providing stock capturing surfaces for accelerating a volume of stock up to rotor velocity, said stock capturing surfaces extending substantially the length of said cylindrical body.

2. A pressure screen apparatus comprising:

a generally cylindrical hollow housing including sidewall means, an end wall having an opening therein, an inlet for receiving a flow of paper stock slurry located adjacent one end of said housing, an accepts outlet centrally located in said sidewall means, and a rejects outlet adjacent the other end of said housing; drive means including a rotatably drive shaft extending through said opening and sealed to said housing; a pair of spaced rings connected to the inner surface of said housing on each side of said accepts outlet between said inlet and said rejects outlet;

a cylindrical profile screen connected to said rings to isolate said accepts outlet from said inlet; and a rotor connected to said drive shaft and located within said screen, said rotor having a profiled outer surface which comprises at least one arcuate surface of decreasing radius connected to itself by a blunt, stock capturing surface extending substantially the length of said rotor facing into the direction of travel forming means for creating substantial turbulence of the slurry and providing a stock and screen-cleaning pulsation cycle of approximately 50% positive and 50% negative in the accepts direction of flow while substantially eliminating any periods wherein stock near said screen experiences no pulse.

3. A pressure screen apparatus comprising:

a generally cylindrical hollow housing including sidewall means, an end wall having an opening therein, an inlet for receiving a flow of paper stock slurry located adjacent one end of said housing, an accepts outlet centrally located in said sidewall means, and a rejects outlet adjacent the other end of said housing;

drive means including a rotatably drive shaft extending through said opening and sealed to said housing; a pair of spaced rings connected to the inner surface of said housing on each side of said accepts outlet between said inlet and said rejects outlet;

a cylindrical profile screen connected to said rings to isolate said accepts outlet from said inlet; and a rotor connected to said drive shaft and located within said screen;

said rotor comprising a profiled outer surface which includes at least two arcuate surfaces connected together by at least two blunt surfaces capable of capturing and accelerating stock substantially to rotor velocity and constituting means for creating substantial turbulence of the slurry and providing a stock and screen-cleaning pulsation cycle of approximately 50% positive and 50% negative in the accepts direction of flow while substantially eliminating any periods wherein stock near said screen experiences no pulse.

* * * * *

UNITED STATES PATENT AND TRADEMARK OFFICE

CERTIFICATE OF CORRECTION

PATENT NO. : 4,981,583

DATED : January 1, 1991

INVENTOR(S) : Peter LeBlanc

It is certified that error appears in the above-identified patent and that said Letters Patent is hereby corrected as shown below:

Column 8, lines 12 and 42: "rotatably" should read --rotatable--.

Signed and Sealed this

Nineteenth Day of May, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,981,583

DATED : 01/01/91

INVENTOR(S) : Peter LeBlanc

It is certified that error appears in the above—identified patent and that said Letters Patent is hereby corrected as shown below:

Column 4, "Table 1"
Column entitled "% Debris",
subheading "Rej.": "7.85" should read --2.85--.

Signed and Sealed this

Tenth Day of August, 1993

*Attest:*

*Attesting Officer*

Michael K. Kirk

MICHAEL K. KIRK

*Acting Commissioner of Patents and Trademarks*